US005743815A

United States Patent [19]

Helderman

[11] Patent Number: 5,743,815

[45] Date of Patent: Apr. 28, 1998

[54] GOLF BALL AND INDENTIFICATION SYSTEM

[76] Inventor: Michael D. Helderman, 2621 N. Markwell, Bethany, Okla. 73008

[21] Appl. No.: 685,185

[22] Filed: Jul. 18, 1996

[51] Int. Cl.[6] ..... A63B 69/36; A63B 37/02

[52] U.S. Cl. ..... 473/353; 473/152

[58] Field of Search ..... 473/353, 151, 473/152

[56] References Cited

U.S. PATENT DOCUMENTS

| | | | |
|---|---|---|---|
| 4,516,770 | 5/1985 | Brookes et al. | 273/11 R |
| 5,016,884 | 5/1991 | Psiol et al. | 273/176 R |
| 5,226,660 | 7/1993 | Curchod | 273/185 B |
| 5,342,051 | 8/1994 | Rankin et al. | 273/185 A |
| 5,354,052 | 10/1994 | Nicholls et al. | 273/34 R |
| 5,439,224 | 8/1995 | Bertoncino | 273/182 A |
| 5,487,542 | 1/1996 | Foley | 273/176 FA |
| 5,582,550 | 12/1996 | Foley | 473/353 |
| 5,626,531 | 5/1997 | Little | 473/353 |

OTHER PUBLICATIONS

AEG Aktiengesellschaft, "Electronic Identification: Trovan®," 8 pages (no date).

Trovan Electronic Identification Systems, "Passive Transponder System," 2 pages (no date).

Trovan Electronic Identification System, "Industrial Passive Transponder Model—ID 200/300" 1 page (no date).

Trovan Electronic Identification System, "Micro Transponder Model—ID 100A/103" 3 pages (no date).

*Primary Examiner*—George J. Marlo

*Attorney, Agent, or Firm*—Robert Treece

[57] ABSTRACT

An electronically identifiable golf ball having a passive transponder implanted therein. The transponder is surrounded by a layer of elastic material which is then surrounded by a rigid housing to protect the passive transponder from the external forces applied to the golf ball.

13 Claims, 3 Drawing Sheets

GOLF BALL AND INDENTIFICATION SYSTEM

BACKGROUND OF THE INVENTION

1. Field of the Invention

The present invention relates to a golf game and electronically identifiable golf balls, and more particularly to golf balls having an internal identification which may be read by an electronic reader in a golf game for scoring one's performance on a driving range.

2. Description of the Prior Art

Generally golf balls are identified by external paint or ink markings such as the name of the manufacturer, a number, the name of the owner, or the like. While this may be sufficient for the individual playing a round of golf and manually keeping score, such markings are not viable for electronic identification of balls.

At least one prior art golf game has a driving range with an automated scoring system, but the means used to identify the balls is optical and requires a Universal Product Code (UPC) on each ball. One disadvantage of this type of ball identification is that dirt, grass or mud may obscure the UPC. Since the UPC is an optical system, wear from being hit by a club, or by impacting the ground or other objects will distort the UPC bars, making the ball unidentifiable. Another disadvantage of an optical system is the necessity of a clear viewing path and light. Thus, an optical system would encounter difficulties when used in a remote location such as a hole in the ground which may also receive leaves or other debris.

SUMMARY OF THE INVENTION

In view of the foregoing disadvantages inherent in the known types of golf balls now present in the prior art, the present invention provides improved golf ball construction wherein the same can be utilized reliably in those situations where identification is desired. As such, the general purpose of the present invention, which will be described subsequently in greater detail, is to provide a new and improved golf ball and golf game which has all the advantages of the prior art and none of the disadvantages.

To attain this, the present invention essentially comprises a golf ball with a passive transponder implanted therein. An external reader provides power for the transponder to emit a unique code, thus distinguishing one golf ball from another. As used in the preferred golf game, remote readers located throughout a playing field are used to identify a ball and thus its assigned player. An electronic processing/storage device or computer may then assign a score to the player based on the location of the ball's final resting point.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in this application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and could not be regarded as limiting. As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application. The abstract is neither intended to define the invention of the application which is measured by the claims, nor is it intended to be limiting as to the scope of the invention in any way.

It is therefore an object of the present invention to provide a new and improved internally labeled golf ball which may be easily and efficiently manufactured and marketed.

It is a further object of the present invention to provide a new and improved internally labeled golf ball which is of a durable and reliable construction.

An even further object of the present invention is to provide a new and improved internally labeled golf ball which is susceptible of a low cost of manufacture with regard to both materials and labor, and which accordingly is then susceptible of low prices of sale to the consuming public, thereby making such a golf ball economically available to the buying public.

Still another object of the present invention is to provide a new and improved golf ball which provides some of the advantages of prior art golf balls, while simultaneously overcoming some of the disadvantages normally associated therewith.

Another object of the present invention is to provide a new and improved golf ball which may be specifically identified without external markings thereon.

Yet another object of the present invention is to provide a new game for scoring accuracy when hitting golf balls.

These together with other objects of the invention, along with the various features of novelty which characterize the invention, are pointed out with particularity in the claims annexed to and forming a part of this disclosure. For a better understanding of the invention, its operating advantages, and the specific objects attained by its uses, reference should be made to the accompanying drawings and descriptive matter in which there is illustrated preferred embodiments of the invention.

BRIEF DESCRIPTION OF THE DRAWINGS

The invention will be better understood, and objects other than those set forth above, will become apparent when consideration is given to the following detailed description thereof. Such description makes reference to the annexed drawings wherein.

DETAILED DESCRIPTION OF THE PREFERRED EMBODIMENTS

Figure 1:
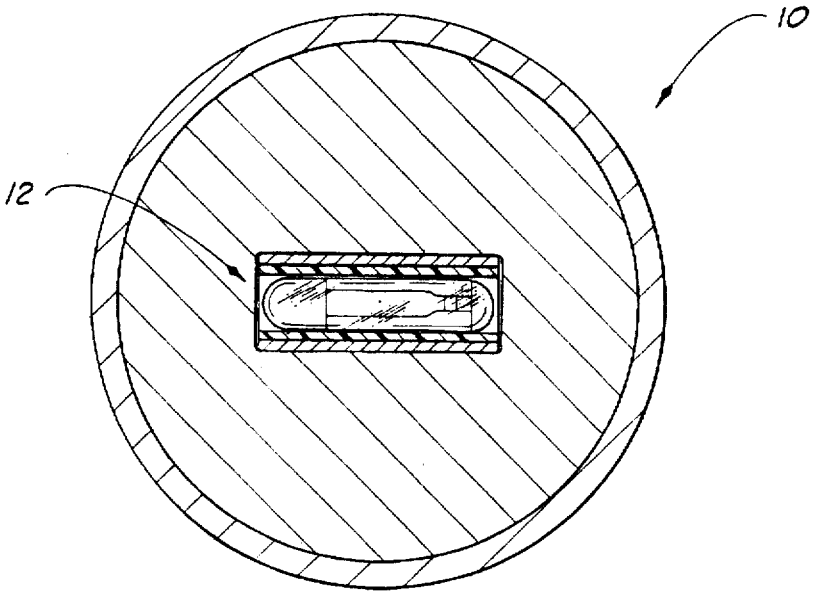
FIG. 1 is a cross-sectional view of a golf ball constructed in accordance with the present invention.

Referring to the drawings in detail and to FIG. 1 in particular, reference character 10 generally designates an electronically identifiable golf ball constructed in accordance with the present invention and reference character 12 designates a transponder assembly implanted in the golf ball 10. Preferably, the transponder assembly 12 contains no batteries and is thus considered to be a passive transponder. Such a passive transponder receives its energy from an electromagnetic field such as may be generated by a reader discussed in greater detail below. The transponder 14 should be maintenance free and have a programmed code which is unique so one golf ball may be distinguished from another. One suitable transponder is the "trovan" ID 100 - glass encapsulated transponder.

Figure 2:
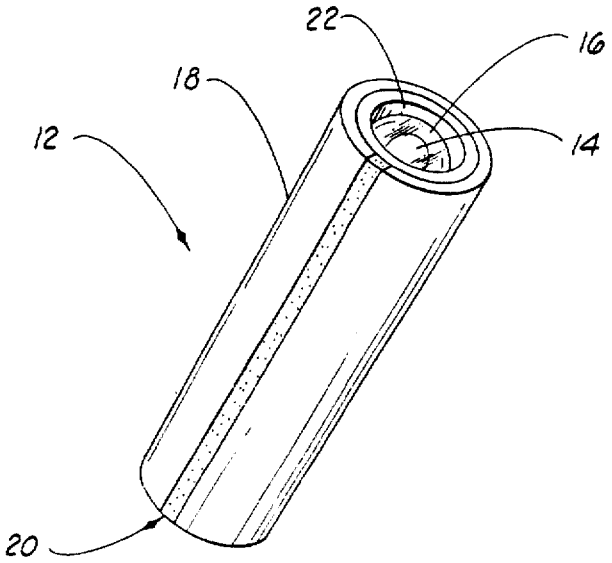
FIG. 2 is an enlarged view of a transponder and its housing which is embedded in the golf ball of FIG. 1.

Referring now to FIG. 2, the transponder assembly 12 is preferably housed within the golf ball 10 in such a manner that it can withstand the forces placed on the ball when struck by a golf club. In the preferred embodiment, the transponder 14 is encapsulated for protection. Some suitable protective materials include, but are not limited to plastic, polymers, glass or other similar protective materials. FIG. 2 shows the transponder encapsulated in glass 16. This hermetically seals the transponder 14 and holds its components in place to help prevent damage from shock. While the transponder 14 may be implanted in a golf ball like this, it has been found that shock reduces life expectancy of the transponder 14 and therefore additional means should be used to reduce shock damage to the transponder.

The preferred additional means includes inserting the glass encapsulated transponder (14 & 16) into a metallic housing such as tube 18. Since the transponder will receive its energy from an electromagnetic field generated outside of the golf ball 10, it is preferable for the metallic housing to include apertures therein. In the case of the metallic tube 18, such apertures are provided at each end of the tube as well as a slit 20 running the length of the tube 18. Since the golf ball 10 will receive tremendous energy when hit, a spacer should be provided to keep the slit 20 from closing when the ball 10 is hit. One suitable spacer material is nylon. The transponder 14 should be held within the tube 14 by an elastic material which will further absorb shock. One way to provide the elastic material is to slide the transponder into silicone tubing 22 and then press the transponder, silicon tubing and all into the aluminum tube 18. The size of the silicon tubing should be such that it fits snugly around the transponder 14 and snugly inside the aluminum tubing 18.

While the transponder 14 may be inserted into an existing golf ball, the ball is preferably formed or made around the transponder and its housing so the outer skin of the golf ball will not be damaged. It is also believed that by forming the ball around the transponder, additional shock resistance will be achieved. If the transponder is inserted into an existing ball, one may drill a hole in the ball and then press the housing containing the transponder into the ball. The remaining portion of the hole should then be plugged.

Figure 3:
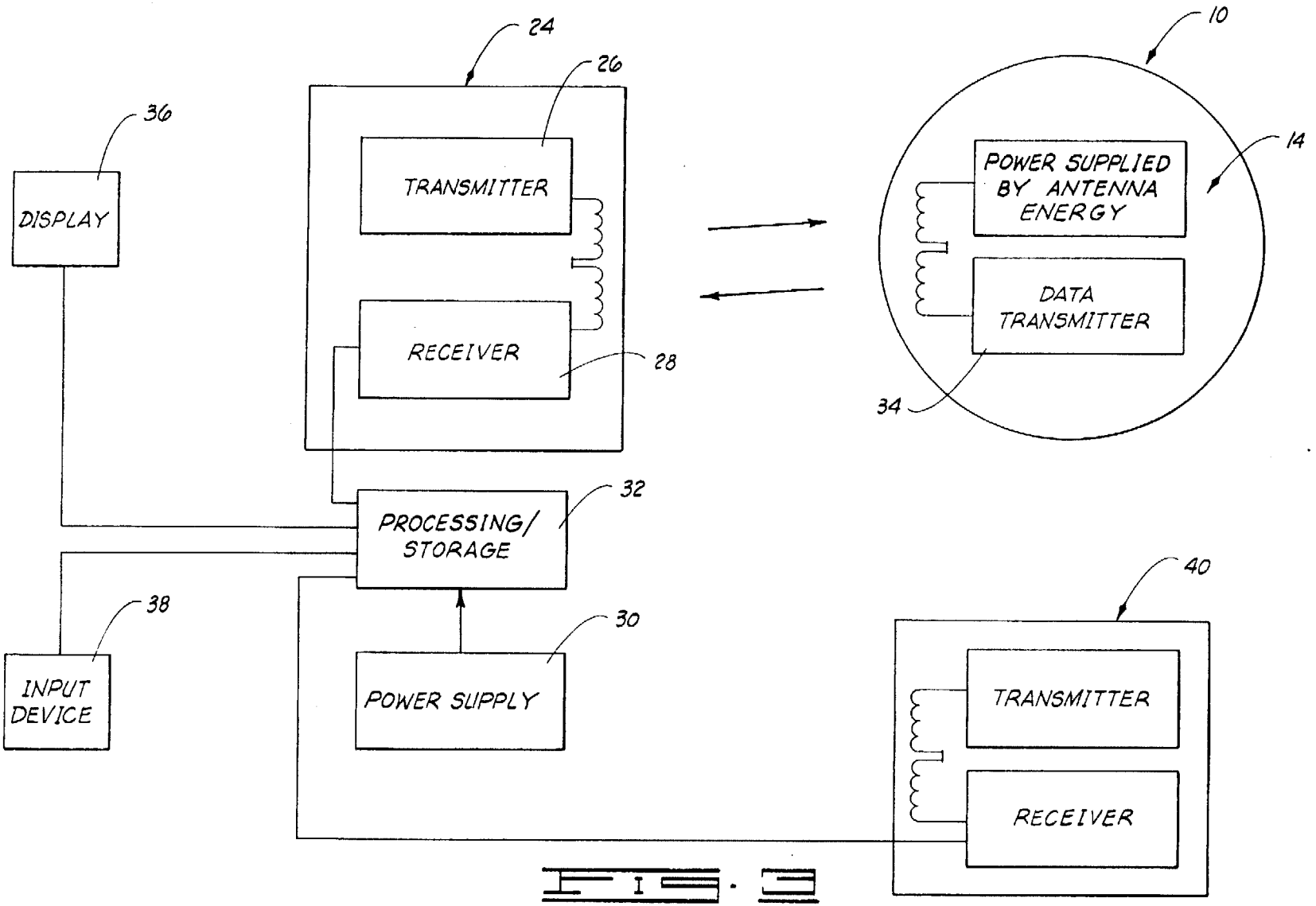
FIG. 3 is a schematic view of a golf ball and reader of the present invention.

Once several golf balls have received the transmitters 14, then a reader (such as reader 24 in FIG. 3) may be used to electronically distinguish one golf ball from another. As shown in FIG. 3, a reader 24 should include a transmitter 26 and a receiver 28, and may have either an internal or external power supply 30. Similarly, a processing/storage device should be connected to or incorporated in the reader 24 for storing data received by the receiver 28.

The transmitter 26 emits electromagnetic radiation which is received by the transponder 14. The electromagnetic radiation provides the energy to power a data transmitter 34 in the golf ball 10. The data transmitter 34 emits a specifically coded electromagnetic radiation back to the reader where it is received by receiver 28. This information may be sent to a remote or local processing/storage unit 32, where the individual golf ball 10 is identified and its location is correlated with the location of the reader. This information is then stored or used.

Since each golf ball 10 may be identified by a reader, the ball identification and the location at which it was read may be correlated with an individual player and displayed. One suitable type of display is a cathode ray tube 36 such as is commonly used with computers. However, it should be realized that additional or different types of displays may also be used. For example, a score board that is visible to all players at a driving range may be used to display the identity and other information about specific golf balls.

Preferably, an input device 38 is provided so that an operator may add information to the processing/storage device 32. For example, an operator dispensing a group of balls to a specific player may wish to identify the player having those balls. This may be done by inputting the player's identity so it may be associated with the balls dispensed. One typical input device which may be used with this invention is a keyboard such as are commonly used with computers. However, by way of example and not limitation, other suitable input devices include microphones, number pads, and scanners.

It should also be noted that additional readers such as reader 40 may be connected to the processing/storage unit 32. By using additional readers situated at different locations one may identify a particular ball as well as its particular location. As illustrated in FIG. 3, a remote receiver, such as receiver 40, may be hard-wired to the processing/storage unit 32. While this is the most preferred embodiment, it should be noted that other means of communication between the remote receiver and the processing/storage unit may be utilized. By way of example, information may be transferred from the remote receiver 40 to the processing/storage unit 32 by radio waves, or by removable connection between the remote receiver 40 and the processing/storage unit 32. One example of this is where the remote receiver 40 is located at a remote location where it temporarily stores information on its own and then is periodically returned to the processing/storage unit where said information is downloaded.

Figure 4:
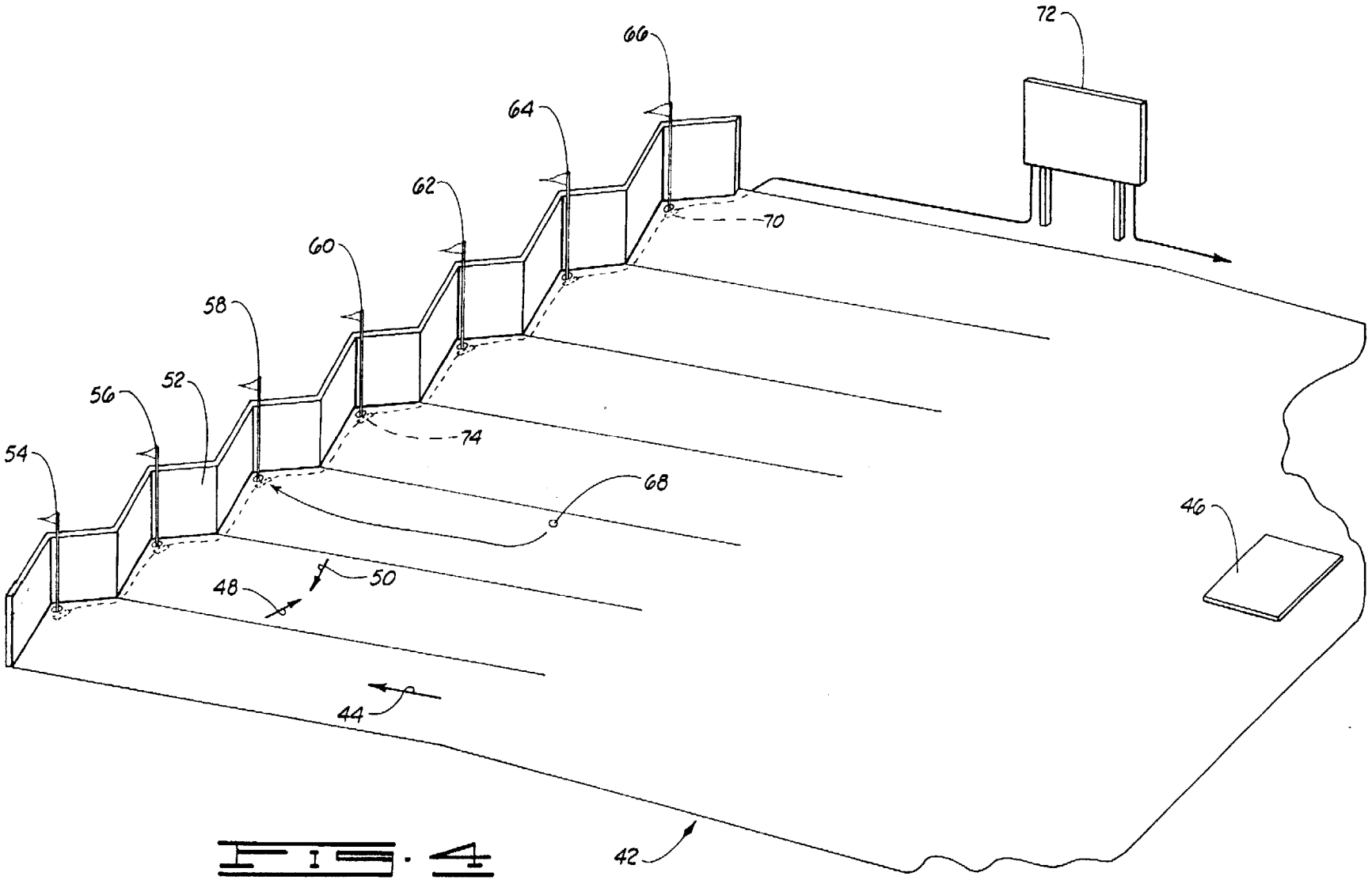
FIG. 4 is a perspective view of a playing field on which the preferred golf game of the present invention may be played.

FIG. 4 illustrates the preferred embodiment of a game which may be played utilizing the electronically identifiable golf ball 10. The game preferably includes a playing field 42 similar in many respects to a commonly used driving range. However, the playing field 42 includes a plurality of slopes, burms, retaining walls or the like to direct the electronically identifiable golf balls to a desired location for identification after being hit by a player. For example, arrow 44 indicates a slope on the playing field toward the flagged area and away from the T-box 46. Arrows 48 and 50 indicate slopes or burms which direct a ball to the center of a flagged area, and wall 52 provides a back stop to prevent balls from passing beyond the flagged area. Thus, a ball landing in the playing field 42, such as ball 68, would travel down to the flagged area and enter a cup at one of the individual flags. Preferably, remote readers such as readers 70 or 74 (only two readers being designated herein) are located at each of the individual flag cups. The scanners are preferably located near to a cup, so ball moving systems are eliminated. Since the transponder code will traverse most solid objects, the scanners may even be buried directly in the ground near each cup. In this way a point score may be assigned to an individual ball depending on which flag cup it enters. It should be noted that the cups may include short passage ways to a ball tub or the like to store a plurality of golf balls so many balls may pass by the reader without emptying the cup.

In the preferred embodiment of the game, which may be played with the electronically identifiable balls on a playing field such as field 42, each player is dispensed 36 electronically identifiable golf balls 10. As the balls 10 are being dispensed, they pass by a reader such as reader 24 (FIG. 3) wherein the code for each ball is recorded and assigned to a player identifier. The player identifier may be the player's name, initials, a number or similar means for distinguishing the player's identity and may be entered by means of the input device 38 shown in FIG. 3.

Each player begins with a score of 96 strokes, and the score will rise or fall depending on where the player hits the balls 10. The score may be displayed on scoreboard 72, so each player can track his or her progress. Similarly, other players may have their scores simultaneously listed on score board 72. The player would hit the ball 10 from the tee box 46 and attempt to drive the ball 10 to the center flag 60. A ball entering the center cup at flag 60 would be read by remote reader 74, wherein the ball would be identified and related to the player. A score of −1 stroke would be combined with the individual's total stroke score, thereby reducing the score on the scoreboard 72 by one stroke. If, however, the player missed the center flag 60 and hit the flags to the immediate left or right (58 or 62 respectively), then the player would receive a reduction in stroke score of ½ of one stroke, thereby reducing the players score on the scoreboard 72 by one half of a point. Thus, the game is designed to reward accuracy and straightness of shots. As flags further from the center flag are encountered, the reduction in score is lessened or the stroke score may even be raised as a penalty stroke. For example, flags 56 and 64 could add one half of a stroke to the player's score, and flags 54 and 66 could add a full stroke to the player's score.

Since a reader at each flag is able to identify each specific golf ball 10 and the player to whom it was dispensed, multiple players may play the game simultaneously and the scoreboard will track each player individually, thus allowing for competitions wherein each player may proceed at his or her own pace.

Since a player's score is recorded electronically, a data base may be created wherein a player may track his history. Other information may also be combined with the score and player identifier, such as club size or make, air temperature, or even the type of shoe or glove worn. This would allow a player to evaluate his or her performance under various conditions.

The following table provides a series of examples of how an individual would score depending on where his golf balls landed in the playing field. By way of illustration, the first row shows a player who had one ball at flag 56, four balls at flag 58, twenty-six balls at flag 60, four balls at flag 62, and one ball at flag 64. The player started with a stroke score of 96 and gained ½ of a stroke for the ball at flag 56, lost two strokes for the four balls at flag 58, lost 26 strokes for the twenty-six balls at center flag 60, lost 2 strokes for the four balls at flag 64 and gained ½ of a stroke for the ball at flag 64. The player finished the game with a total score of 67.

Similarly, the third row shows a player which hit 22 balls to the center, 13 balls to the flags on either side of the center, and the remaining two balls to other flags. Since this player was not as accurate as the player shown in the first line, his/her score is somewhat higher with a final stroke score of 69.

| Flag 54 +1 | Flag 56 +½ | Flag 58 −½ | Flag 60 −1 | Flag 62 −½ | Flag 64 +½ | Flag 66 +1 | Total Score |
|---|---|---|---|---|---|---|---|
| 0 | 1 | 4 | 26 | 4 | 1 | 0 | 67 |
| 0 | 1 | 5 | 24 | 5 | 1 | 0 | 68 |
| 0 | 1 | 6 | 22 | 6 | 1 | 0 | 69 |
| 0 | 1 | 7 | 20 | 7 | 1 | 0 | 70 |
| 0 | 2 | 7 | 18 | 7 | 2 | 0 | 73 |
| 0 | 2 | 8 | 18 | 8 | 2 | 0 | 72 |
| 0 | 2 | 10 | 14 | 10 | 2 | 0 | 74 |
| 0 | 3 | 9 | 12 | 9 | 3 | 0 | 78 |
| 0 | 4 | 9 | 10 | 9 | 4 | 0 | 81 |
| 1 | S | 8 | 8 | 8 | 5 | 1 | 87 |
| 2 | 6 | 7 | 6 | 7 | 6 | 2 | 93 |
| 4 | 7 | 5 | 4 | 5 | 7 | 4 | 102 |
| 8 | 5 | 4 | 2 | 4 | 5 | 8 | 111 |
| 10 | 6 | 2 | 0 | 2 | 6 | 10 | 120 |
| 12 | 5 | 1 | 0 | 1 | 5 | 12 | 124 |

The preceding chart is a list of examples of scoring possibilities in the preferred game. Many other possibilities exist and the chart should be viewed as a means of explaining the game and not as a limitation.

Changes may be made in the combinations, operations and arrangements of the various parts and elements described herein without departing from the spirit and scope of the invention as defined in the following claims.

I claim:

1. A system comprising:

a golf ball;

a glass encapsulated passive transponder implanted within the golf ball for receiving energy from an external source and using said energy to transmit a distinct code signal;

an energy source for transmitting energy to the passive transponder;

a reader for receiving the distinct code signal transmitted by the passive transponder; and wherein the glass encapsulated passive transponder is surrounded by an elastic material and both the elastic material and the glass encapsulated passive transponder are inside a rigid housing.

2. The system of claim 1 wherein the rigid housing is a metallic tube.

3. The system of claim 2 wherein the metallic tube is made from aluminum, and the tube has a slit therein to allow transmissions from the transponder to effectively escape the tube.

4. The system of claim 3 further comprising a spacer of elastic material in the slit in the metallic tube to keep the slit in the metallic tube from closing when the golf ball is hit.

5. The system of claim 4 wherein the spacer is nylon.

6. The system of claim 2 wherein elastic material between the glass encapsulated transponder and metallic tube is silicone tubing.

7. An electronically identifiable golf ball comprising:

a golf ball;

a transponder implanted within the golf ball;

a rigid housing surrounding said transponder;

an elastic material between the transponder and the rigid housing to further absorb shock when the golf ball is hit.

8. An electronically identifiable golf ball of claim 7 wherein the rigid housing is made from a metallic material.

9. An electronically identifiable golf ball of claim 8 wherein the rigid housing is a metallic tube with two ends and a length.

10. An electronically identifiable golf ball of claim 9 wherein the metallic tube has apertures at each end of said tube.

11. An electronically identifiable golf ball of claim 10 wherein the metallic tube has a slit running the length of said tube.

12. An electronically identifiable golf ball of claim 11 further comprising a spacer of elastic material in the slit in the metallic tube to keep the slit in the metallic tube from closing when the golf ball is hit.

13. An electronically identifiable golf ball of claim 12 wherein the spacer is nylon.

* * * * *